US006086464A

United States Patent [19]

Ulfig et al.

[11] Patent Number: 6,086,464

[45] Date of Patent: Jul. 11, 2000

[54] CMP PLATEN PLUG

[75] Inventors: Robert M. Ulfig, Sunnyvale; Richard E. Lamm, Union City, both of Calif.

[73] Assignee: Advanced Micro Devices, Inc., Sunnyvale, Calif.

[21] Appl. No.: 09/261,993

[22] Filed: Mar. 5, 1999

[51] Int. Cl.[7] ..... B24B 7/00

[52] U.S. Cl. ..... 451/259; 260/508

[58] Field of Search ..... 451/259, 262, 451/508, 509, 510, 520, 521

[56] References Cited

U.S. PATENT DOCUMENTS

| | | | |
|---|---|---|---|
| 2,047,256 | 7/1936 | Courter | 451/510 |
| 3,307,300 | 3/1967 | Field | 451/521 |
| 3,562,968 | 2/1971 | Johnson et al. | 451/521 |
| 3,742,656 | 7/1973 | Amos | 451/508 |
| 5,910,041 | 8/1999 | Duescher | 451/28 |
| 5,967,882 | 10/1999 | Duescher | 451/57 |
| 5,993,298 | 11/1999 | Duescher | 451/56 |

*Primary Examiner*—M. Rachuba
*Attorney, Agent, or Firm*—Davis Chin

[57] ABSTRACT

An improved chemical mechanical polishing apparatus for polishing a semiconductor wafer used in the fabrication of silicon-based semiconductor devices is provided so as to eliminate an air pocket bubble from being formed underneath a polishing pad without the need for cutting the same. This is achieved by a CMP platen plug which is disposed in a recess formed in a top cover plate member so as to completely fill the recess in order to displace the air pocket. The polishing pad is then secured over the platen plug and the top cover plate member. As a result, the useful life of the polishing pad has been prolonged.

13 Claims, 2 Drawing Sheets

CM P PLATEN PLUG

BACKGROUND OF THE INVENTION

This invention relates generally to chemical mechanical polishing apparatuses and more particularly, it relates to a chemical mechanical polishing (CMP) apparatus for polishing a semiconductor wafer used in the fabrication of silicon-based semiconductor devices which includes a CMP platen plug for eliminating an air pocket bubble from forming underneath a polishing pad.

As is known to those skilled in the art of integrated circuit fabrication, the formation of integrated circuits is started initially with the production of high quality semiconductor wafers which are made from a silicon substrate or the like. The semiconductor wafers are usually sliced from ingots of various size dimensions. The slicing process and subsequent processing can cause surface damage to the semiconductor wafers and will result in wafers having variations in thickness and a rough surface. Since an extremely flat surface is desirable for further processing into semiconductor devices, it is generally known to subject the wafers to a polishing process, sometimes referred to as chemical mechanical polishing (CMP), so as to achieve such a flat surface. The polished wafer is generally required to be free from defects and be extremely flat when it is utilized in the fabrication of sub-micron semiconductor devices.

One conventional CMP apparatus for polishing a semiconductor wafer used in the fabrication of semiconductor integrated circuit devices is illustrated in FIG. 1 and is labeled "Prior Art." As can be seen, this conventional polishing apparatus 10 is similar to the type Avanti427 which is manufactured and sold by IPEC Planar of Phoenix, Ariz. The polishing apparatus 10 is housed and supported on a frame 12 which includes, among other things, a plurality of working stations formed of a cleaning station 14, a first or primary polishing station 16, and a secondary or final polishing station 18. For purposes of convenience, the other components not related to the present invention have been purposely omitted.

As is well-known in the art, a carrier or wafer-carrier head 20 is rotatably mounted on a polishing arm or spindle for moving a semiconductor wafer (not shown) from a pick-up station (also not shown) over the cleaning station 14. The semiconductor wafer is picked up from the pick-up station under a vacuum and is held to the bottom or underneath side of the wafer-carrier head 20 and is then moved to the cleaning station 14. The cleaning station 14 includes a trough 22 into which the wafer-carrier head 20 with the wafer is lowered and against a cleaning spray (not shown). Next, the semiconductor wafer is moved to the primary polishing station 16.

The primary polishing station 16 also includes a trough 24 in which is disposed a first metal polish platen 26 having a polishing pad 28 mounted on its top surface. For polishing, the wafer-carrier head with the wafer held on its bottom surface is forced downwardly against the polishing pad 28. During the time of polishing, no vacuum is used to support the wafer in the wafer-carrier head 20 so that the wafer is sandwiched between the carrier 20 and the polishing pad 28. Both the carrier and the polish platen 26 are rotatable during the polishing step. A primary slurry of cutting compound is applied to the surface of the polishing pad 28 during the primary polishing operation.

The secondary polishing station 18 is substantially the same as the primary polishing station 16 and likewise includes a trough 30 in which is disposed a second metal polish platen 32 having a polishing pad 34 mounted on its top surface. For polishing, the carrier 20 with the wafer held on its bottom surface is once again forced downwardly against the polishing pad 34. During the time of polishing, no vacuum is used to support the wafer-carrier head 20 so that the wafer is sandwiched between the carrier 20 and the polishing pad 34. Both the carrier 20 and the polish platen 32 are being rotated during the polishing step. A secondary slurry is applied to the surface of the polishing pad 34 during the secondary polishing operation.

However, the conventional polishing apparatus 10 has the disadvantage that each of the polish platens 26, 32 has a recess located in its center so as to allow access to certain hardware located below the respective platen for assembly, repair, and the like. Since the recesses in the platens are covered by the respective polishing pads 28, 34 applied to the top surfaces thereof, it was found that during the polish pad application air pockets would form in the recesses so as to cause bubbling due to the heating of the air trapped in the recesses and thereafter expanding. This heating and expansion of the trapped air will adversely affect the uniformity of the flatness in the polished wafers.

In current practice, the air pocket "bubble" problem created underneath the polishing pad is solved by a user through a cutting procedure such as with a razor blade. Each of the polishing pads is cut so as to form a slit in order to release any air expansion caused by the heating of the trapped air underneath the respective polishing pads which have been adhesively secured to the top surface of the metal polish platens in an air-tight manner. While this technique overcomes the problem of bubbling, it will create another setback due to the fact that the primary and secondary slurries applied during the polishing process will permeate the polishing pads through the cuts made and thus reduce the useful life of the polishing pads.

The present invention was made in view of this latter problem so as to eliminate the air pocket and reduce or remove any bubble formation without the need of cutting the polishing pads. As a result, the useful life of the polishing pads has been increased and therefore the manufacturing and labor costs have been reduced but yet the uniformity of flatness has still been maintained. Further, the overall CMP processing operation has been made more effective and efficient with greater dependability.

SUMMARY OF THE INVENTION

Accordingly, it is a general object of the present invention to provide an improved chemical mechanical polishing apparatus for polishing a semiconductor wafer which overcomes the disadvantage of the prior art polishing machine.

It is an object of the present invention to provide an improved chemical mechanical polishing apparatus which is operated on a more efficient and effective basis with greater dependability.

It is another object of the present invention to provide an improved chemical mechanical polishing apparatus for polishing semiconductor wafers while maintaining a high uniformity of flatness.

It is still another object of the present invention to provide an improved chemical mechanical polishing apparatus which eliminates the formation of any air pockets without the need of cutting of polishing pads.

It is yet still another object of the present invention to provide an improved chemical mechanical polishing apparatus which includes a CMP platen plug disposed in a recess formed in a solid metal polish platen and covered by a polishing pad so as to avoid bubble formation.

In a preferred embodiment of the present invention, there is provided an improved chemical mechanical polishing apparatus for polishing a semiconductor wafer used in the fabrication of silicon-based semiconductor devices. The polishing apparatus consists of a primary polish platen assembly and a secondary polish platen assembly. The primary polish platen assembly includes at least a first top cover plate member having a first center hole, a first platen plug, and a first polishing pad. The first platen plug is disposed in the first center hole for completely filling the same so as to eliminate an air pocket. The first polishing pad is secured over the top cover plate member.

Similarly, the secondary polish platen assembly includes at least a second top cover plate member having a second center hole, a second platen plug, and a second polishing pad. The second platen plug is disposed in the second center hole for completely filling the same so as to eliminate an air pocket. The second polishing pad is secured over the second top cover plate member.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, wherein.

DESCRIPTION OF THE PREFERRED EMBODIMENT

Figure 1:
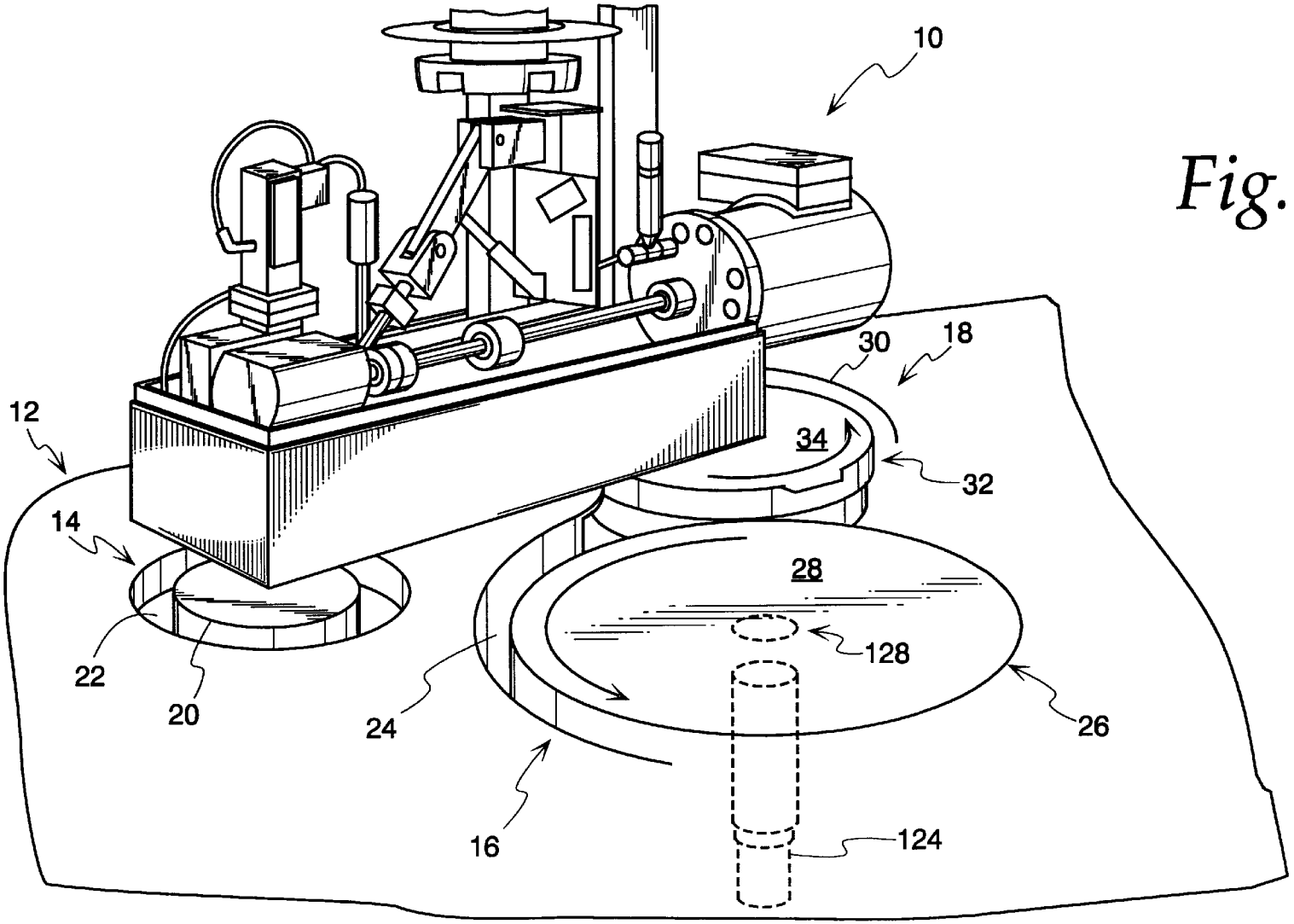
FIG. 1 is a perspective view of a conventional chemical mechanical polishing apparatus, illustrating schematically the arrangement of various working stations.
Figure 2:
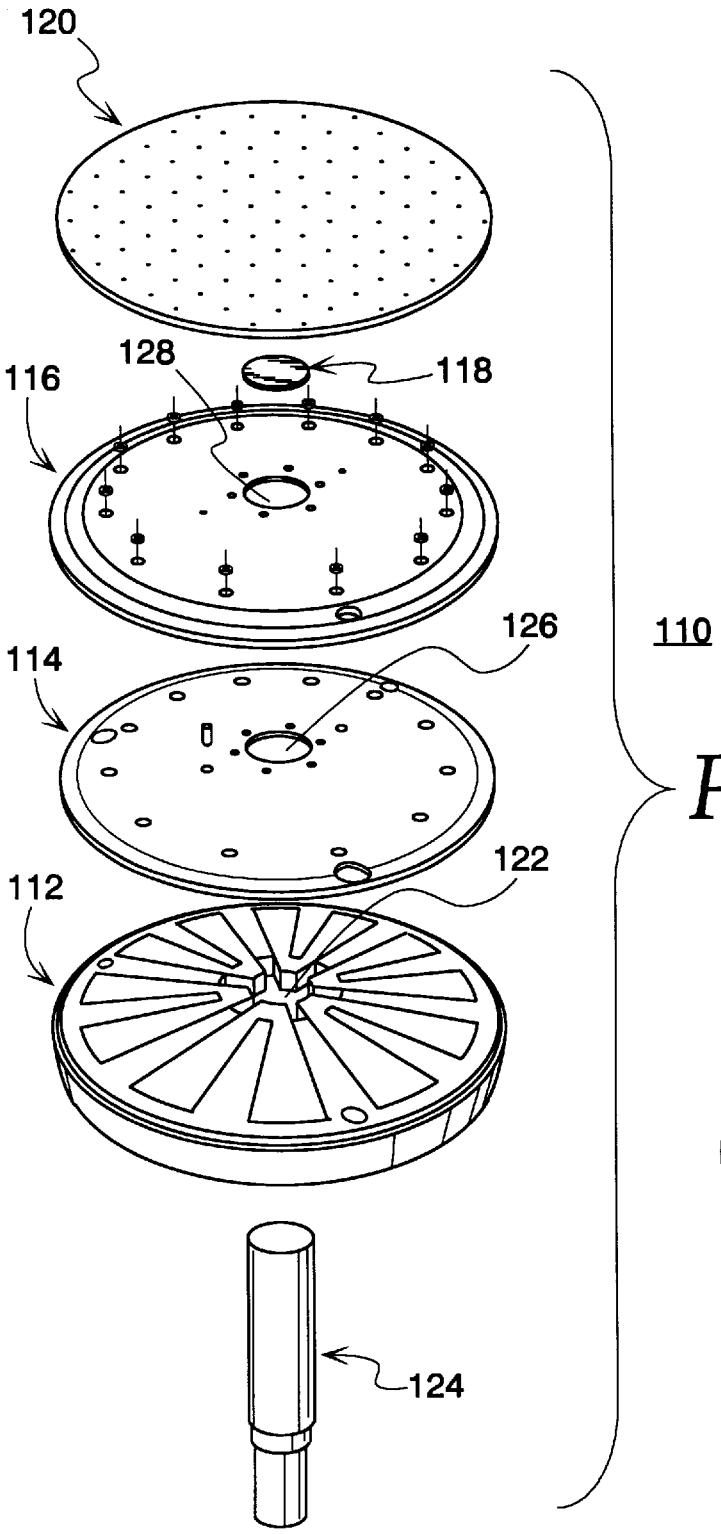
FIG. 2 is an exploded, perspective view, illustrating the detailed components of the primary or secondary metal polish platen assembly including a platen plug for use in the chemical mechanical polishing apparatus of FIG. 1.

Referring now in detail to the drawings, there is illustrated in FIG. 2 an exploded, perspective view of a metal polish platen assembly 110 for use in the chemical mechanical polishing (CMP) apparatus 10 of FIG. 1 for polishing a semiconductor wafer used in the fabrication of silicon-based semiconductor devices. It should be understood that the polish platen assembly may be used for either the primary polish platen 26 or the secondary polish platen 32 of FIG. 1. The metal polish platen assembly 110 is comprised of a metal polish platen 112, an intermediate spacer member 114, a top cover plate member 116, a CMP platen plug 118, and a polishing pad 120.

The metal polish platen 112 is a large flat disc-shaped member which is approximately 40 inches in diameter and has a central opening 122 through which extends a platen drive shaft 124 for connection thereto. The intermediate spacer member 114 has also a disc-like shape and is dimensioned so as to overlie the polish platen 112. The intermediate spacer member also has a central opening 126 which is aligned with the opening 122 in the polish platen 112. On top of the spacer member 114, there is positioned the top cover plate member 116 which is also dimensioned so as to overlie the spacer member 114 and the metal polish platen 112. It will be noted that the top cover plate member 116 has a center hole 128 which is aligned with the openings 126 and 122 so as to permit access to certain hardware located underneath the polish platen 112.

In the conventional CMP apparatus of FIG. 1, the polishing pad 120 is typically adhesively secured to the upper surface of the top cover plate member 116 and overlies the center hole 128. If it were not for the CMP platen plug 118 of the present invention, the air trapped in the center hole 128 or recess located underneath the polishing pad 120 will create an air pocket and will cause the bubbling problem during the polishing process due to the heating and expansion of the air as was previously pointed out. Also, the prior art solution of cutting a slit or the like in the polishing pad 120 will not only physically damage the pad, but will allow the slurry applied during the polishing operation to permeate the polishing pad and shorten the length of time that it can be used.

In order to overcome or eliminate the formation of any air bubble underneath the polishing pad 120 without requiring the cutting of the pad, the inventors of the present invention have developed a very simple and effective means of displacing the air pocket. This is achieved simply by the provision of a solid filler-material which is placed into the center hole 128 formed in the top cover plate member 116 so as to remove any bubble formation.

Since the polishing pad is generally made of a synthetic fiber felt impregnated with a polymeric resin, it is preferable that the type of filler-material used be suitably compatible with the polishing pad. While the filler-material may be of any type of resin or metal compound, it is preferable that the filler-material be formed of a small CMP platen plug 118 which is made from a metal such as aluminum or the like. The CMP platen plug is dimensioned and contoured so as to be insertable into and to completely fill the center hole 128 in the top cover plate member 116 so as to be flush with the upper surface thereof.

As a result, when the polishing pad 120 is adhesively secured to the top cover plate member 116 in an air-tight manner to form the finished polished platen assembly 110, there will no longer be an air pocket trapped. Thus, the life of the polishing pad 120 has been increased. Furthermore, the labor costs will be reduced due to the lesser number of times that the polishing pads will be required to be replaced. In addition, the uniformity of flatness will be maintained more accurately during the polishing process since the polishing pad 120 will not have any bubble formed thereunder.

Figure 3:
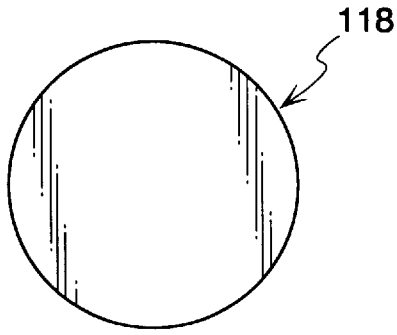
FIG. 3 is a top plan view of the CMP platen plug of FIG. 2, constructed in accordance with the principles of the present invention.
Figure 4:
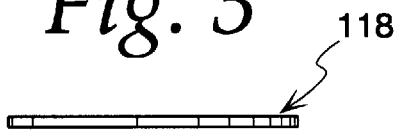
FIG. 4 is a cross-sectional view, taken along the lines 4—4 of FIG. 3.

Referring now to FIGS. 3 and 4, there is shown in more detail the CMP platen plug 118 of the present invention. FIG. 3 is a top plan view of the CMP platen plug. FIG. 4 is a cross-sectional view of the platen plug, taken along the lines 4—4 of FIG. 3. The CMP platen plug 118 is formed of a substantially flat, small disc. The CMP platen plug 118 has a diameter of approximately 1.5 inches and a thickness of about 1/16 inch. In use, the platen plug 118 is placed in the recess or center hole 128 in the top cover plate member 116 and then covered by the polishing pad 120 so as to form the completed polish platen assembly 110.

From the foregoing detailed description, it can thus be seen that the present invention provides an improved chemical mechanical polishing apparatus for polishing a semiconductor wafer used in the fabrication of silicon-based semiconductor devices so as to eliminate an air pocket bubble from forming underneath a polishing pad. This is achieved by the provision of a CMP platen plug which is disposed in a recess formed in a top cover plate member and then covered by the polishing pad.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. A chemical mechanical polishing apparatus for polishing a semiconductor wafer used in the fabrication of silicon-based semiconductor devices, said apparatus comprising in combination:

a primary polish platen assembly;

said primary polish platen assembly including at least a first top cover plate member having a first center hole, a first platen plug, and a first polishing pad;

said first platen plug being disposed in said first center hole for completely filling the same so as to eliminate an air pocket;

said first polishing pad being secured over said first top cover plate member;

a secondary polish platen assembly;

said secondary polish platen assembly including at least a second top cover plate member having a second center hole, a second platen plug, and a second polishing pad;

said second platen plug being disposed in said second center hole for completely filling the same so as to eliminate an air pocket; and said second polishing pad being secured over said second top cover plate member.

2. A chemical mechanical polishing apparatus as claimed in claim 1, wherein each of said first and second platen plugs is formed of a metal material.

3. A chemical mechanical polishing apparatus as claimed in claim 2, wherein said metal material is aluminum.

4. A chemical mechanical polishing apparatus as claimed in claim 1, wherein each of said first and second platen plugs is formed of a substantially small flat disc.

5. A chemical mechanical polishing apparatus as claimed in claim 4, wherein said disc has a diameter of approximately 1.5 inches and a thickness of about 1/16 inch.

6. A chemical mechanical polishing apparatus for polishing a semiconductor wafer used in the fabrication of silicon-based semiconductor devices, said apparatus comprising in combination:

a primary polish platen assembly;

said primary polish platen assembly including at least a first top cover plate member having a first center hole, first platen plug means, and a first polishing pad;

said first platen plug means being disposed in said first center hole for completely filling the same so as to eliminate an air pocket;

said first polishing pad being secured over said first top cover plate member;

a secondary polish platen assembly;

said secondary polish platen assembly including at least a second top cover plate member having a second center hole, second platen plug means, and a second polishing pad;

said second platen plug means being disposed in said second center hole for completely filling the same so as to eliminate an air pocket; and said second polishing pad being secured over said second top cover plate member.

7. A chemical mechanical polishing apparatus as claimed in claim 6, wherein each of said first and second platen plug means is formed of a metal material.

8. A chemical mechanical polishing apparatus as claimed in claim 7, wherein said metal material is aluminum.

9. A chemical mechanical polishing apparatus as claimed in claim 6, wherein each of said first and second platen plug means is formed of a substantially small flat disc.

10. A chemical mechanical polishing apparatus as claimed in claim 9, wherein said disc has a diameter of approximately 1.5 inches and a thickness of about 1/16 inch.

11. A chemical mechanical polishing apparatus for polishing a semiconductor wafer used in the fabrication of silicon-based semiconductor devices, said apparatus comprising in combination:

a primary polish platen assembly;

said primary polish platen assembly including at least a first top cover plate member having a first center hole, a first filler-material, and a first polishing pad;

said first filler-material being disposed in said first center hole for completely filling the same so as to eliminate an air pocket;

said first polishing pad being secured over said first top cover plate member;

a secondary polish platen assembly;

said secondary polish platen assembly including at least a second top cover plate member having a second center hole, a second filler-material, and a second polishing pad;

said second filler-material being disposed in said second center hole for completely filling the same so as to eliminate an air pocket; and said second polishing pad being secured over said second top cover plate member.

12. A chemical mechanical polishing apparatus as claimed in claim 11, wherein each of said first and second filler-materials is formed of a metal compound.

13. A chemical mechanical polishing apparatus as claimed in claim 11, wherein each of said first and second solid filler-materials is formed of a resin compound.

* * * * *